United States Patent [19]

Heuer

[11] Patent Number: 4,529,156

[45] Date of Patent: Jul. 16, 1985

[54] PEDESTAL FOR A GARDEN SPRINKLER

[76] Inventor: Vernon W. Heuer, Box 6, Revillo, S. Dak. 57259

[21] Appl. No.: 511,290

[22] Filed: Jul. 6, 1983

[51] Int. Cl.[3] ..... B05B 17/00

[52] U.S. Cl. ..... 248/87

[58] Field of Search ..... 248/85–88, 248/511, 545, 310, 172, 670, 176, 79, 82, 171

[56] References Cited

U.S. PATENT DOCUMENTS

| | | | |
|---|---|---|---|
| 207,756 | 9/1878 | Maguire . | |
| 515,625 | 2/1894 | Stott . | |
| 755,403 | 3/1904 | Sipe | 248/171 |
| 1,137,995 | 5/1915 | McLaren . | |
| 1,158,361 | 10/1915 | Beck | 248/310 |
| 1,223,276 | 4/1917 | Haney . | |
| 2,048,608 | 7/1936 | Holland | 248/167 |
| 2,446,723 | 8/1948 | Schaechterle . | |
| 2,495,995 | 1/1950 | Warrens | 248/82 |
| 2,711,927 | 6/1955 | Miller . | |
| 3,687,405 | 8/1972 | Cala | 248/545 |

FOREIGN PATENT DOCUMENTS

| | | | |
|---|---|---|---|
| 1179211 | 1/1970 | United Kingdom | 248/176 |

*Primary Examiner*—Reinaldo P. Machado
*Assistant Examiner*—Alvin Chin-Shue
*Attorney, Agent, or Firm*—Norman B. Rainer

[57] ABSTRACT

A pedestal apparatus is provided for supporting an oscillating type lawn sprayer having a parallel track base at a fixed height above a lawn. The apparatus is comprised of a post which can be driven into the ground, and support means associated with the upper extremity of the post. The support means comprises two elongated pivotably interconnected arms adapted to move horizontally in scissor-like juxtaposition. A spring under tension spans the arms to urge them together. Upraised gripping tabs mounted upon the extremities of the arms are adapted to engage the track base of the sprayer. A positionable clamp aligns a garden hose with the supported sprayer.

2 Claims, 4 Drawing Figures

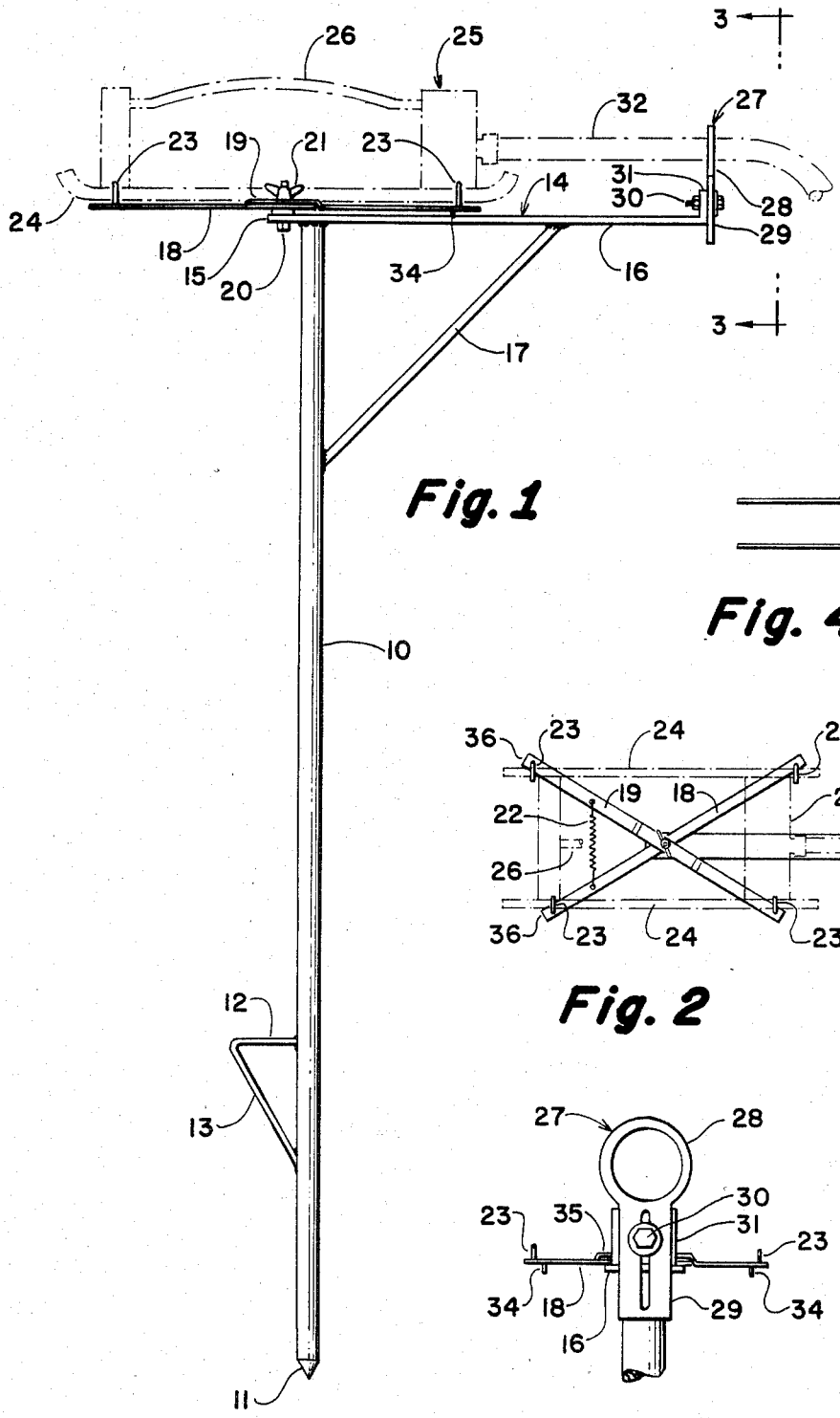
Fig. 1
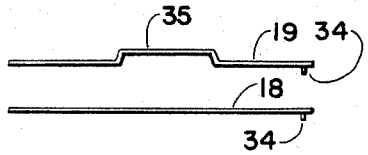
Fig. 4
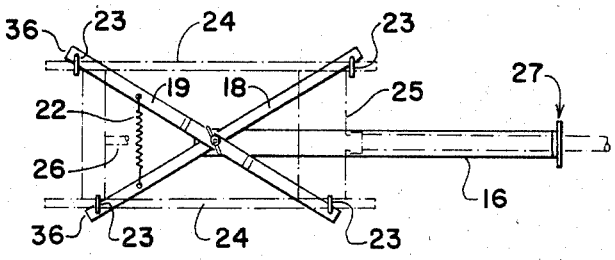
Fig. 2
Fig. 3

PEDESTAL FOR A GARDEN SPRINKLER

BACKGROUND OF THE INVENTION

This invention relates to apparatus useful in the application of controlled amounts of water to outdoor growing vegetation, and more particularly concerns a pedestal or standard for elevating above ground level a water-dispensing device.

The watering of ornamental and food-value trees, crops, plants, and grasses in generally achieved with spraying devices designed to distribute the water over a wide area. The size and location of the watered area is generally determined by the pressure of the water, the nature of the spraying device, and its elevation above the ground. Greater elevation of the spraying device increases the area of water distribution because it creates a more favorable trajectory path for water emitted from the sprayer. An additional advantage of the greater elevation is that the emitted water will travel over the top of closely adjacent vegetation instead of being caught and diverted thereby.

The use of standards with lawn sprinklers has been disclosed in U.S. Pat. Nos. 207,756; 1,223,276; 515,625; 1,137,995; 2,711,927; 2,446,723 and elsewhere. Such standards are in general designed either merely to hold a conventional nozzle attached to the end of a garden hose, or are designed to be associated with sophisticated specialized spraying devices.

A type of lawn sprayer in widespread use involves a perforated elongated tube which is caused to oscillate by the action of water delivered to the sprayer, whereby the water is distributed over a substantially rectangular area. The tube is mounted above a base comprised of two parallel tracks. Such sprayer, which will hereinafter be referred to as an oscillating tube sprayer, is efficient in operation and low in cost. Although the effectiveness and versatility of the oscillating tube sprayer can be increased by elevating it above ground level, the sought elevated position cannot be achieved by the devices of the aforementioned patents.

It is accordingly the primary object of the present invention to provide apparatus for elevating an oscillating tube sprayer above ground level.

It is another object of this invention to provide a pedestal apparatus capable of facile positioning in the ground and facile acceptance and release of an oscillating tube sprayer.

A still further object is to provide a pedestal of the aforesaid nature of simple design and rugged construction capable of withstanding the rough usage and extreme conditions of exposure to which such an article is customarily subjected.

These objects and other objects and advantages of the invention will be apparent from the following description.

SUMMARY OF THE INVENTION

The above and other beneficial objects and advantages are accomplished in accordance with the present invention by an improved pedestal apparatus which comprises:

(a) a rigid post having a pointed lower extremity, (b) a shoulder affixed to said post above said lower extremity and adapted to be engaged by the foot of the user to apply downward force to cause said pointed extremity to penetrate the ground, and (c) support means associated with the upper extremity of said post and comprising paired horizontally adjustable holding means interactively engaged by tensioning means, and adjustable clamping means for positioning a garden hose.

In preferred embodiments of the apparatus of this invention, the post is fabricated of iron pipe or rod having an outside diameter between ½" and 1", and the shoulder and support means are welded to the pipe. The holding means are preferably adapted to engage the parallel tracks of the base of an oscillating tube lawn sprayer.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing:

FIG. 1 is a side view of an embodiment of the pedestal apparatus of this invention showing an oscillating tube lawn sprayer emplaced thereupon.

FIG. 2 is a top view of the apparatus of FIG. 1.

FIG. 3 is an enlarged fragmentary end view taken along the line 3—3 of FIG. 1.

FIG. 4 is a side view of the retaining arms utilized in the apparatus of FIG. 1.

DESCRIPTION OF THE PREFERRED EMBODIMENT

Referring to the drawing, an embodiment of the apparatus of this invention is shown comprised of post 10 fabricated of ¾" O.D. galvanized iron pipe having a pointed insert 11 at the lower extremity thereof. A shoulder 12 comprised of flat iron of about 3½" length is welded to said post at a site about 25% of the distance going from the lower to the upper extremity of the post. The outward extremity of shoulder 12 is supported by shoulder brace 13 which is welded to said post and to said outer extremity.

Support base 14, consisting of a rectangular iron bar 12" long, 1" wide and ½" thick, is welded to the upper extremity of post 10 in a manner such that about one inch of said base is on one side of the post, forming short leg 15, and about 11" of the base are on the opposite side of the post, forming long leg 16. A support brace 17 extends angularly in welded attachment to post 10 and the underside of long leg 16.

A lower retaining arm 18 and an upper retaining arm 19 are pivotably attached at their centers to short leg 15 by means of threaded bolt 20 and associated wing nut 21. Both retaining arms are elongated rigid members of substantially equal length and are adapted to undergo scissor-like movement in a horizontal direction. An upraised center region 35 of upper retaining arm 19 enables the outer extremities of said arm to be coplanar with lower retaining arm 18. A tension spring 22 interengages said retaining arms at a site between their centers and their opposed forward extremities 36. Upraised gripping tabs 23 are positioned upon the retaining arms adjacent each extremity thereof. The four tabs 23 are disposed in a substantially rectangular array at all angles of separation of the retaining arms, and are adapted to securely embrace the parallel tracks 24 of lawn sprayer 25 equipped with oscillating tube 26. Accordingly, the lawn sprayer can be quickly secured by and released from the retaining arms. Downwardly directed abutment tabs 34 are mounted to the underside of the retaining arms for the purpose of preventing motion of said arms past long leg 16.

A hose clamp 27, positioned atop support base 14 adjacent the extremity of long leg 16 and opposite the rearward extremities of the retaining arms, is comprised of ring 28 attached to slotted vertical stem 29. The stem is adapted to be held in vertically adjustable engagement by threaded bolt 30 which engages butt plate 31 welded to base 14. Because it supports and aligns the garden hose 32 at substantially the same height as the lawn sprayer, the hose clamp provides greater stability to the assembly.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Pedestal apparatus for supporting a lawn sprayer having parallel tracks, said apparatus comprising:

(a) a rigid post having a pointed lower extremity, (b) a shoulder affixed to said post and adapted to be engaged by foot to apply downward force to cause said pointed extremity to penetrate the ground, and (c) support means associated with the upper extremity of said post and comprised of:

(1) holding means comprised of upper and lower elongated rigid arms pivotably interengaged adjacent their centers to permit scissor-like movement in a horizontal direction, the extremities of said arms being adapted to support said lawn sprayer and provided with upraised tabs adapted to embrace the tracks of said sprayer, one of said arms being provided with an upraised central region which causes its extremities to be in coplanar disposition with the extremities of the other arm, said arms being urged together by a tension spring which interengages said arms at a site between their extremities and centers, and (2) a support base which holds said holding means, and;

(3) adjustable clamping means attached to said support base for positioning a garden hose in alignment with said lawn sprayer.

2. Lawn spraying apparatus comprising:

(a) a lawn sprayer having an oscillating perforated tube mounted to a base having parallel tracks, (b) a rigid post having a pointed lower extremity, (c) a shoulder affixed to said post and adapted to be engaged by foot to apply downward force causing said pointed extremity to penetrate the ground, and (d) support means associated with the upper extremity of said post and comprised of:

(1) holding means comprised of upper and lower elongated rigid arms pivotably interengaged adjacent their centers to permit scissor-like movement in a horizontal direction, the extremities of said arms being adapted to support said lawn sprayer and provided with upraised tabs adapted to embrace the tracks of said sprayer, one of said arms being provided with an upraised central region which causes its extremities to be in coplanar disposition with the extremities of the other arm, said arms being urged together by a tension spring which interengages said arms at a site between their extremities and centers, and (2) a support base which holds said holding means, and;

(3) adjustable clamping means attached to said support base for positioning a garden hose in alignment with said lawn sprayer.

* * * * *